United States Patent [19]

Meek

[11] Patent Number: 4,610,308

[45] Date of Patent: Sep. 9, 1986

[54] BOTTOM HOLE SAMPLER AND SAFETY VALVE AND VALVE THEREFOR

[75] Inventor: Dale E. Meek, Missouri City, Tex.

[73] Assignee: Schlumberger Technology Corporation, Houston, Tex.

[21] Appl. No.: 686,576

[22] Filed: Dec. 27, 1984

[51] Int. Cl.[4] ..... F21B 34/10; F21B 49/08

[52] U.S. Cl. ..... 166/321; 166/264; 166/323

[58] Field of Search ..... 166/334, 321, 264, 373, 166/374, 375, 3.9, 386, 167, 168, 169, 322, 323, 324

[56] References Cited

U.S. PATENT DOCUMENTS

| | | | |
|---|---|---|---|
| 2,442,642 | 6/1948 | Eckel | 166/319 X |
| 3,543,793 | 12/1970 | Dollison | 166/323 X |
| 3,901,321 | 8/1975 | Mott | 166/321 X |
| 3,993,136 | 11/1976 | Mott | 166/375 |
| 4,063,593 | 12/1977 | Jessup | 166/264 X |
| 4,446,922 | 5/1984 | Bowyer et al. | 166/386 X |
| 4,474,242 | 10/1984 | Upchurch | 166/323 |
| 4,553,598 | 11/1985 | Meek et al. | 166/321 X |
| 4,576,234 | 3/1986 | Upchurch | 166/319 |

*Primary Examiner*—Stephen J. Novosad
*Assistant Examiner*—David J. Bagnell

[57] ABSTRACT

In the representative embodiment of the invention disclosed herein, upper and lower valve means including rotatable ball members cooperatively seated on axially-movable annular seats are spatially arranged within a tubular housing and independently controlled by upper and lower valve-actuator means. Pressure-responsive means maintain the valve seats sealingly engaged with the ball members regardless of whether the pressure within the sample chamber is greater than or less than the exterior pressure. Reset means coupled to the valve-actuator means allow the valve means to be manually opened and closed while the new and improved sample-collecting tool is at the surface without having to disassemble the tool.

17 Claims, 11 Drawing Figures

79
80
48
66
65
64
68
62
38
27
63
50
69
50a
44
34
36
39
49
49
76
71
72
73
77
75
78
74

70
71
5
5
30

BOTTOM HOLE SAMPLER AND SAFETY VALVE AND VALVE THEREFOR

FIELD OF THE INVENTION

This invention relates generally to apparatus for obtaining a sample of fluid from a producing formation, generally called a bottom hole sampler, and in particular to a sampler of the type that is generally used in combination with drill stem testing tools. In another aspect, this invention relates to a downhole safety valve. And in yet another aspect, the invention relates to a valve for use in such tools.

BACKGROUND ART

Drill stem tests are conducted primarily to determine whether a fluid bearing formation penetrated by the well bore will produce oil or gas in sufficient quantities to justify completing the well in that formation. To obtain this information, the formation is relieved of the hydrostatic pressure of the drilling fluid in the well bore sufficiently to allow the fluids in the formation to flow into the well bore and up the drill pipe under substantially the same conditions that would exist after the well is completed. Measurements are made of the pressure in the well bore adjacent the formation, while the formation is flowing and while it is shut in. It is also helpful in the evaluation of the formation to obtain a sample of the produced fluid at the pressure and temperature of the producing formation. This is the function of the bottom hole sampler to which this invention relates.

Most bottom hole samplers include a tubular member that is connected into the drill string and forms part of the passageway through which the formation fluid travels as it moves up the drill pipe. The sampler is usually located in the drill string as close to the producing formation as practical. At the end of the test, valves located at opposite ends of the tubular member are closed trapping the formation fluid in the sampler at or about the temperature and pressure of the fluid in the formation.

In the past, both slide valves and ball valves have been used in samplers. Ball valves are generally preferred because, when open, they do not reduce the opening through the sampler below that of the drill pipe. For examples of these prior art samplers using both slide and ball valves, see U.S. Pat. Nos. 3,308,887 and 4,063,593.

Ball valve type samplers in the past have been prone to malfunction due to solids, such as cuttings, wall cake, barites or the like, collecting in the somewhat complicated parts used to operate the ball valves. In many cases, if one of the ball valves will not close for any reason, the other will not either, since they are both closed by the same mechanism. This is not a critical situation as far as the sampler is concerned since if one doesn't close, the sampler cannot function properly anyway, but it is important when the sampler is acting as a safety valve.

OBJECTS OF THE INVENTION

Therefore, it is an object of this invention to provide an improved full bore ball valve type bottom hole sampler having upper and lower ball valves which are independently controlled by a valve closing mechanism for each ball valve that is simple in operation and requires few moving parts.

It is a further object and advantage of this invention to provide a ball valve sampler having means for readily closing and reopening the ball valves while the sampler is at the surface to determine without disassembling the sampler whether the ball valves are properly assembled and in good working order just prior to running the sampler into the well.

It is another object and feature of this invention to provide a ball valve sampler having spaced ball valves defining a sampler chamber therebetween, with each valve member being seated on pressure-responsive valve seat means cooperatively arranged to be urged into sealing engagement with the valve member without regard to whether the pressure of the fluids trapped within the sampler chamber is less than or greater than the well pressure acting on the opposite side of the valve member thereby insuring that fluid samples will not leak out of the chamber due to changing pressure conditions across the valves as the sampler is removed from the well bore.

SUMMARY OF THE INVENTION

These and other objects of the present invention are attained by spatially disposing first and second ball valves within a tubular housing for defining a sampler chamber therein. First and second pressure-operated valve operators are arranged above and below the chamber for selectively closing the valve members independently of one another. To permit testing the sampler before it is lowered into a well bore, first and second reset means coupled to the valve operators are cooperatively arranged to manually return the valve members to their open positions after the sampler is tested at the surface. As an added aspect of the present invention, each of the ball valves include new and improved valve seat means including an axially-movable annular valve seat having sealing means thereon and supported by biasing means urging the valve seat into sealing engagement with the valve member. The new and improved valve seat means further include an axially-movable annular follower cooperatively arranged between the housing and the valve seat and sealingly engaged therewith for urging the seat toward the valve member whenever the pressure within the sample chamber is greater than the outside pressure. Means are also provided for directing the outside pressure against the valve seat for urging the valve seat against the valve member.

These and other advantages, features, and objects of this invention will be apparent to those skilled in the art from a consideration of this specification, including the attached drawings and appended claims.

DESCRIPTION OF A PREFERRED EMBODIMENT OF THE INVENTION

Figure 1:
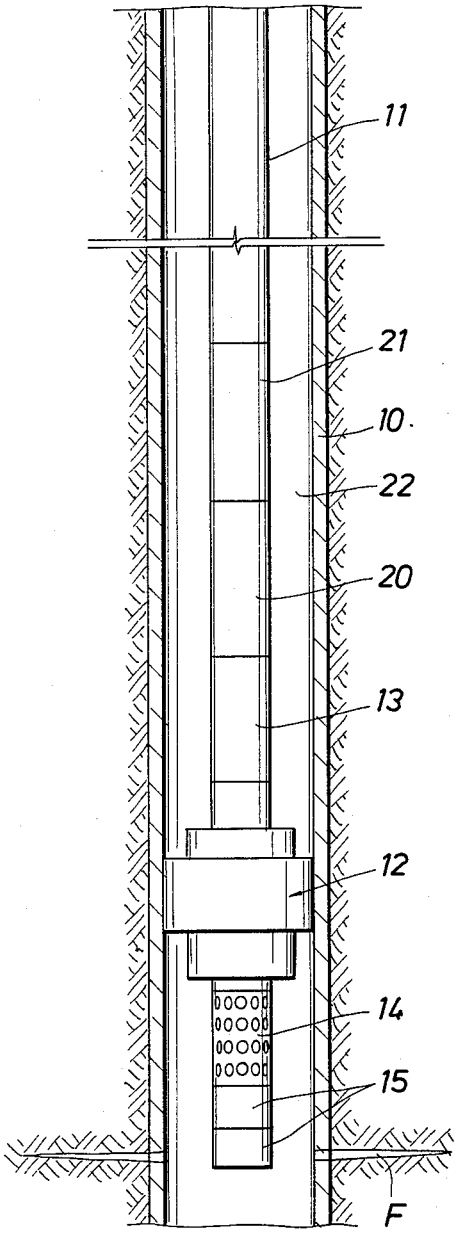
FIG. 1 is a vertical section through a well bore showing the bottom hole assembly of the tools used in a typical drill stem test.

The bottom hole assembly shown in FIG. 1 is a typical one for conducting a drill stem test in a cased hole. Here casing string 10 has been run into the well bore and cemented in the conventional manner to isolate the various producing formations, only one of which, F, is shown in FIG. 1. The assembly is supported by drill pipe 11 that extends to the surface and provides a conduit through which the fluids produced by the formation flow to the surface. Packer 12 isolates formation F from the hydrostatic pressure of the drilling fluid in annulus 22 between the drill pipe and the casing above the packer and allows the pressure below the packer to be reduced to induce the fluids in the formation to flow into the casing below the packer and up through the drill pipe to the surface.

Test valve assembly 13 is closed as the bottom hole assembly is run into the well bore. Usually a small amount of water called a water blanket is in the drill pipe above the test valve so that the pressure differential across the test valve does not become excessive. When the packer is set and the test valve is opened, only the hydrostatic pressure of the water blanket opposes the flow of fluids into the well bore from the formation. Below packer 12 is a perforated section of pipe 14 through which the well fluid can flow into the drill string. Pressure gauges are located in sections 15 below the perforated pipe to measure and record the flowing and shut-in pressure of the fluids in the formation. One or more bottom hole samplers can be included in the bottom hole assembly. In FIG. 1, two samplers 20 and 21 are connected between the drill pipe and the test valve.

Figure 2A:
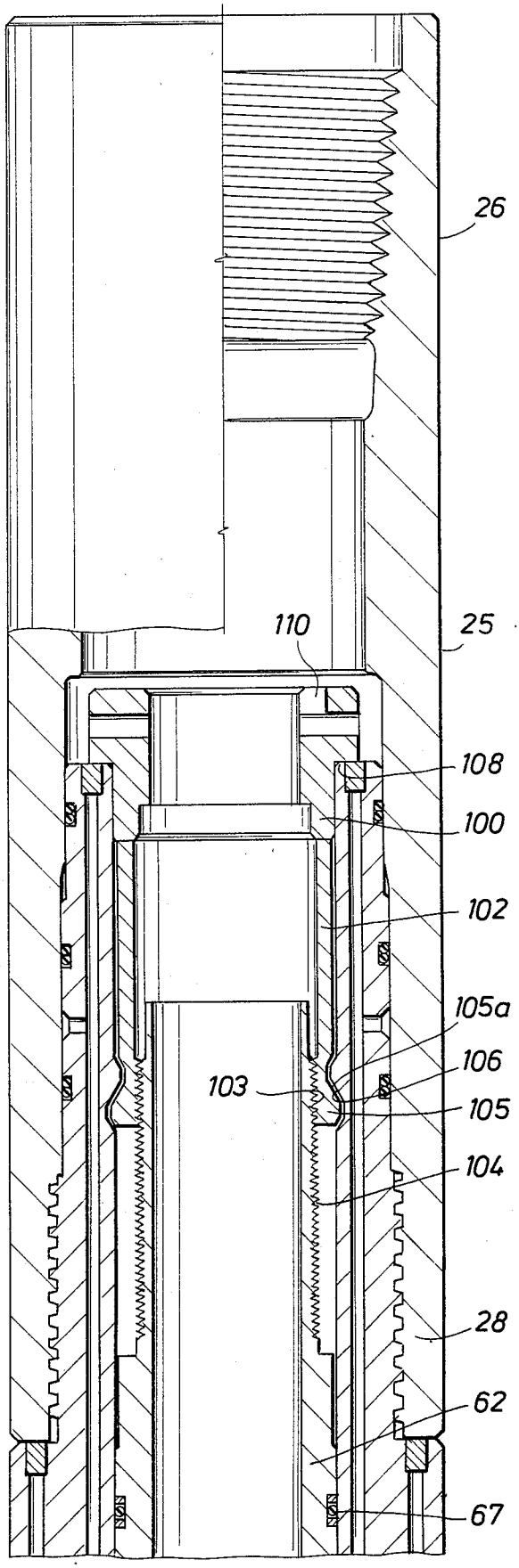
FIGS. 2A–2E are vertical sectional views of the preferred embodiment of the sampler and safety valve of this invention.
Figure 2B:
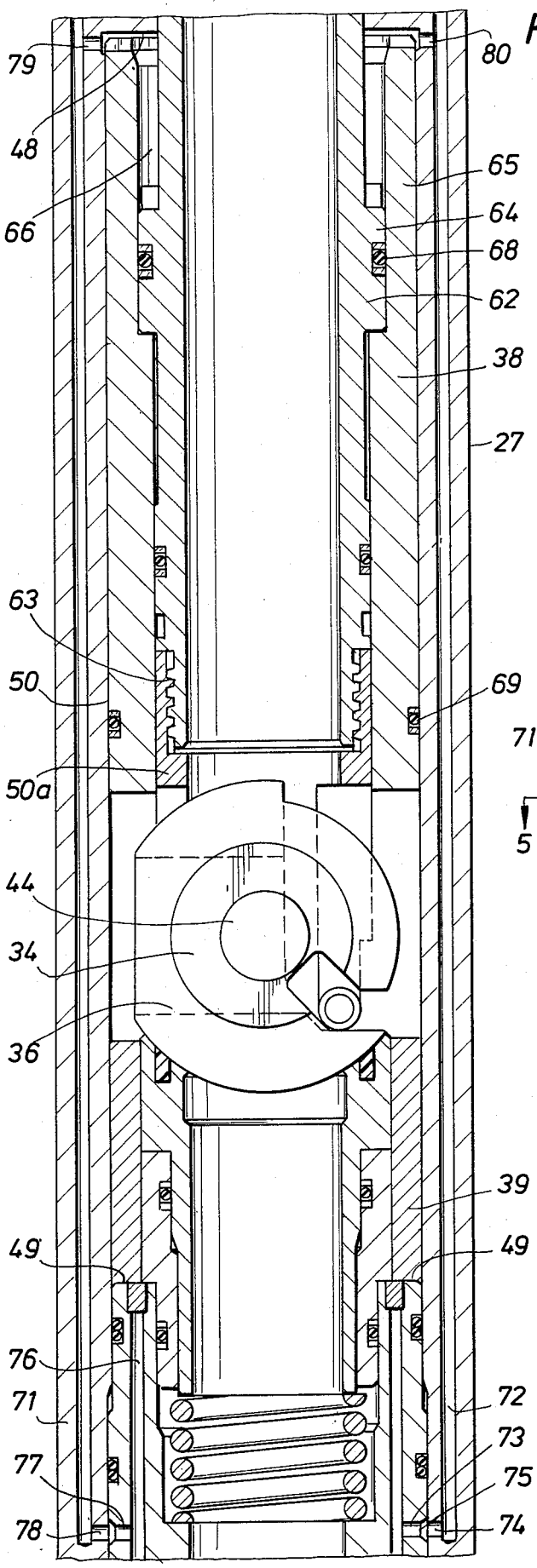
Figure 2C:
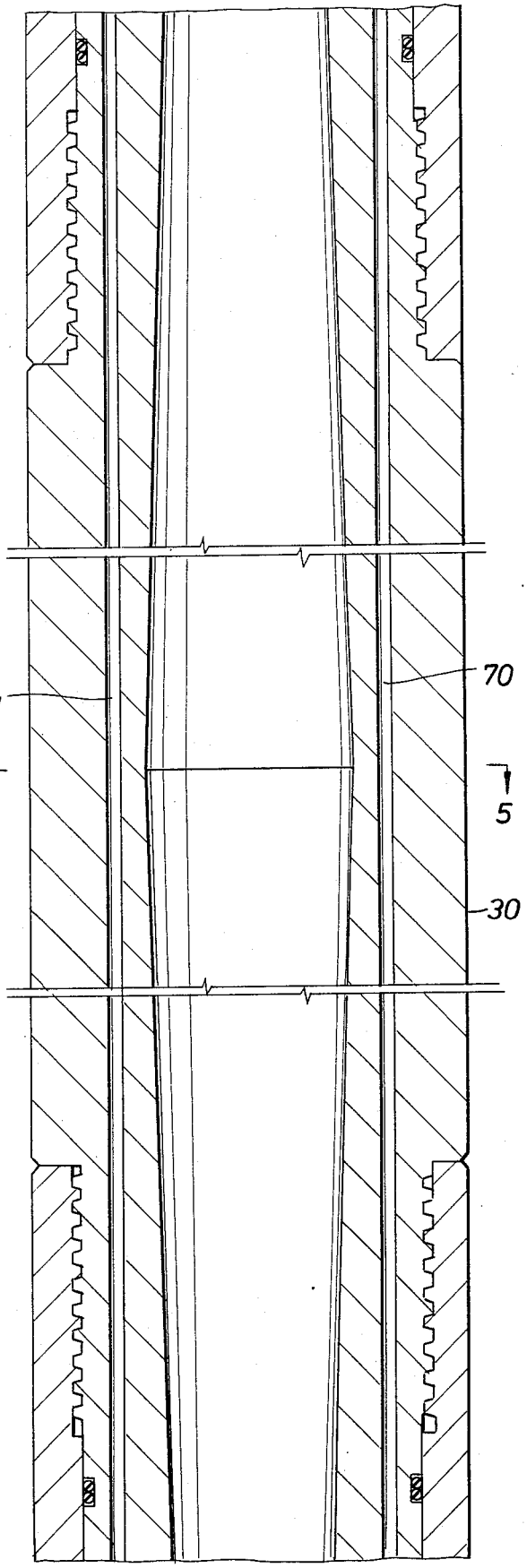
Figure 2D:
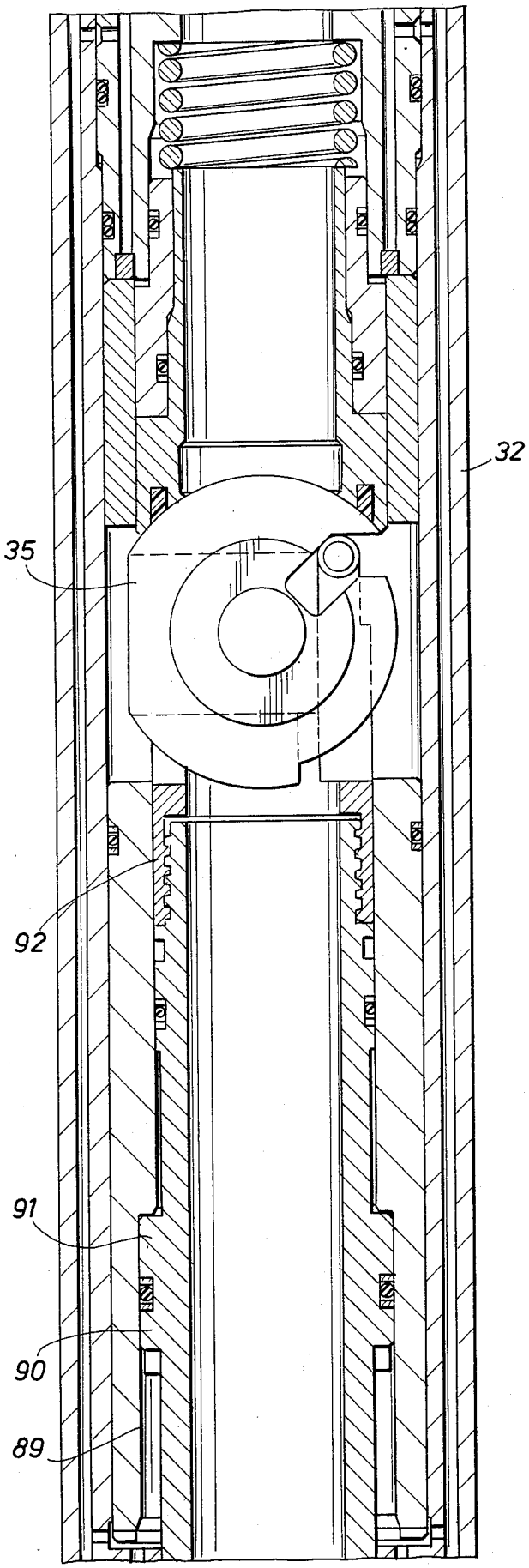
Figure 2E:
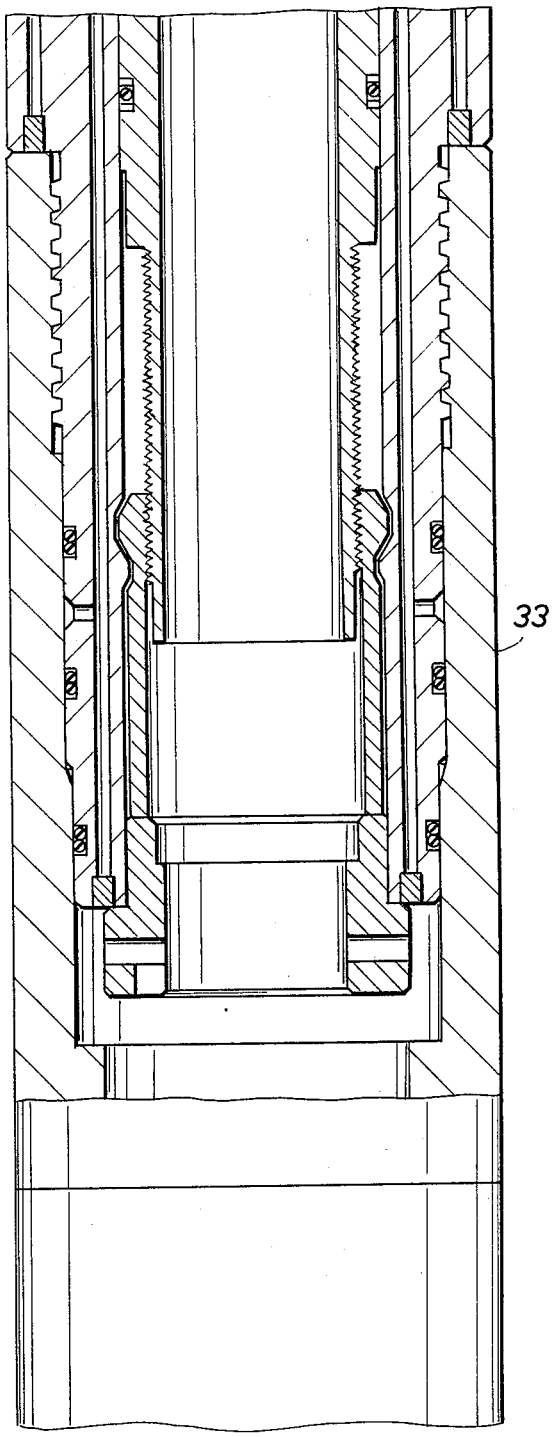

The preferred embodiment of the bottom hole sampler and safety valve 20 of this invention is shown in vertical section in FIGS. 2A–2E. Several tubular members are connected together to confine the fluid going through the sampler and to provide a tubular outer housing having an axial fluid passageway defining a sampler chamber and enclosing the internal working parts of the sampler, as shown in FIG. 2A. Starting at the upper end of the sampler, top sub 25 includes tool joint box 26 for connecting the sampler to the drill pipe. The lower end of the top sub is connected to upper valve housing 27 by threaded connection 28. The lower end of upper valve housing 27 (FIG. 2B) is connected to drain sub 30 (FIG. 2C). Below drain sub 30 are lower valve housing 32 (FIG. 2D) and bottom sub 33 (FIG. 2E). The bottom sub is equipped with a drill pipe pin connection for connecting to the box of the next lower component of the string.

Located in the upper and lower valve housing 27 and 32 are new and improved ball valves arranged in accordance with the principles of the present invention which respectively employ ball shaped valve elements 34 and 35. These elements are identical as are the upper and lower valve operator mechanisms for opening and closing the valves and the valve seats that engage the ball members. The only difference is that the ball valves are arranged within the outer housing in opposition to one another to dispose the valve operators in the passageway outside of the sample chamber between the upper and lower ball valves. Therefore, only the ball valve in the upper housing 27 will be described in detail.

Figure 3:
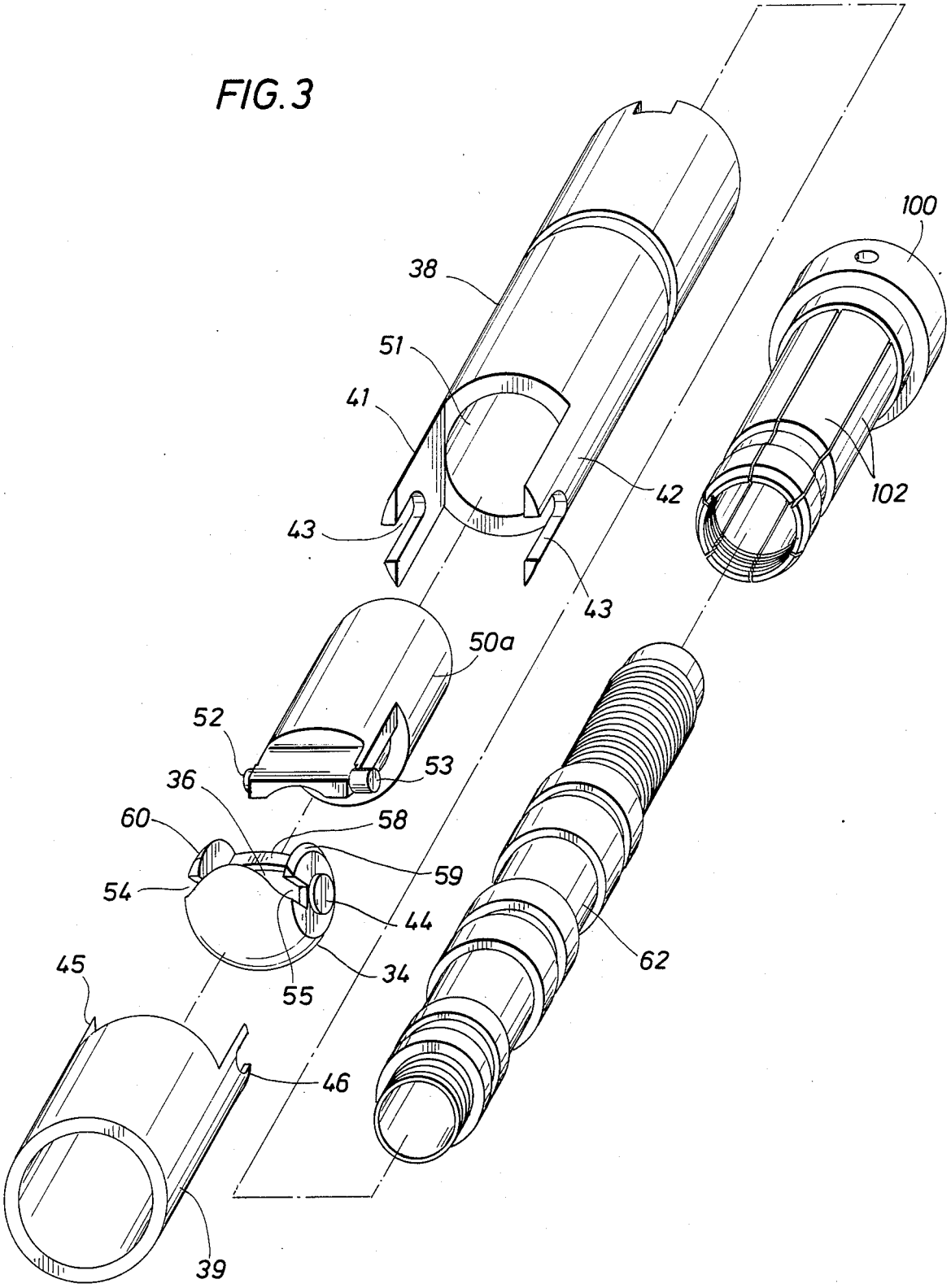
FIG. 3 is an exploded isometric view of one of the ball valves of the sampler of this invention.

As seen in FIG. 2B, the ball member 34 has central opening 36 that is moved into alignment with the longitudinal axis of the sampler when the valve is opened and is moved to a position transverse the longitudinal axis when the valve is closed. The valve is shown in the closed position in FIG. 2B. It is mounted for rotation in upper valve housing 27 by upper valve cage 38 and lower valve cage 39. Both valve cages, as best seen in FIG. 3, are tubular members having parallel arms extending toward the ball. Upper cage 38 has parallel arms 41 and 42 extending from the tubular portion of the cage. Each arm is slotted to receive trunnions 44 located on opposite sides of ball 34. Arms 45 and 46 on lower cage 39 extend into slots 43 of arms 41 and 42 and engage the other side of the trunnions 44 so that the ball member 34 is operatively journalled on the cage arms for rotation about the transverse pivotal axis defined by the trunnions.

The cages hold the ball from longitudinal movement relative to the cages and in turn the cages are held against longitudinal movement relative to upper valve housing 27 by shoulder 48 on the upper valve housing and the upper end 49 of drain sub 30.

Figure 4A:
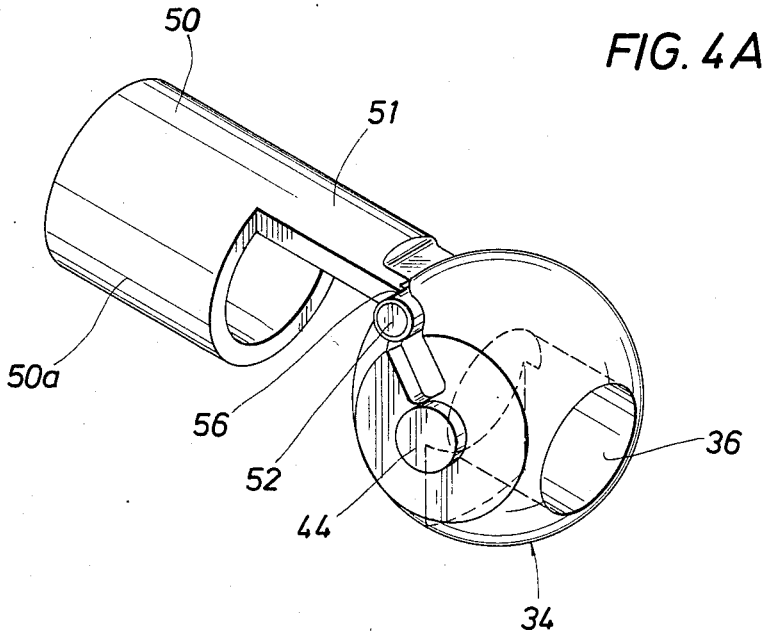
FIGS. 4A and 4B are isometric views of the valve operator and ball when the valve is open and closed.

Valve operator means are provided to engage the ball and rotate the ball between its open and closed positions upon longitudinal movement of the valve operator means. In the exploded view of the upper ball valve shown in FIG. 3, it will be seen that the valve operator 50 includes tubular section 50*a* that is supported for longitudinal movement along its longitudinal axis by bore 51 of upper cage member 38. As best seen in FIG. 4A, the tubular member 50*a* is shaped to define an elongated arm 50*b* along one side thereof which supports outwardly-projecting pins or stub shafts 52 and 53 which are slidably engaged within complemental inclined slots 54 and 55 on opposite sides of ball 34. Bushings 56 can be mounted on the stub shafts to reduce the friction between the stub shafts and the surface of the grooves as the operator moves the ball between the open and closed positions as shown in FIGS. 4A and 4B.

Figure 4B:
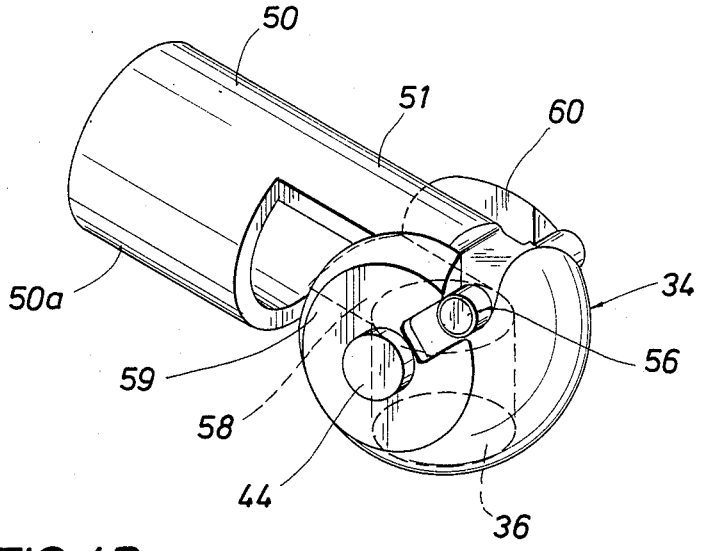

To accommodate arm 51*a* as it moves the ball from the open position of FIG. 4A to the closed position of FIG. 4B, window 58 is milled out of the ball leaving sidewalls 59 and 60 that are spaced enough to allow arm 51*a* to move between them as it moves the valve to the closed position. Slots 54 and 55 are cut in sidewalls 59 and 60.

As shown in FIGS. 2B and 3, the upper ball valve further includes piston means comprised of a tubular operator mandrel 62 that is slidably arranged within bore 51 of the upper valve cage 38 and connected to valve operator 50 by threads 63. An intermediate portion of the operator mandrel 62 is enlarged in diameter to provide a piston 64 which is complementally fitted within an enlarged-diameter annular space 66 arranged in the upper portion of upper valve cage 38. O-rings 67 and 68 are cooperatively arranged between operator mandrel 62 and valve cage 38 to confine a pressured operating fluid within annular chamber 66 when the mandrel is to be moved downwardly to close the upper ball valve. A third O-ring 69 is cooperatively arranged between the lower portions of valve cage 38 and mandred 62 to provide an annular chamber at atmospheric pressure below piston 64 into which the piston moves upon downward travel of the operator mandrel.

Figure 5:
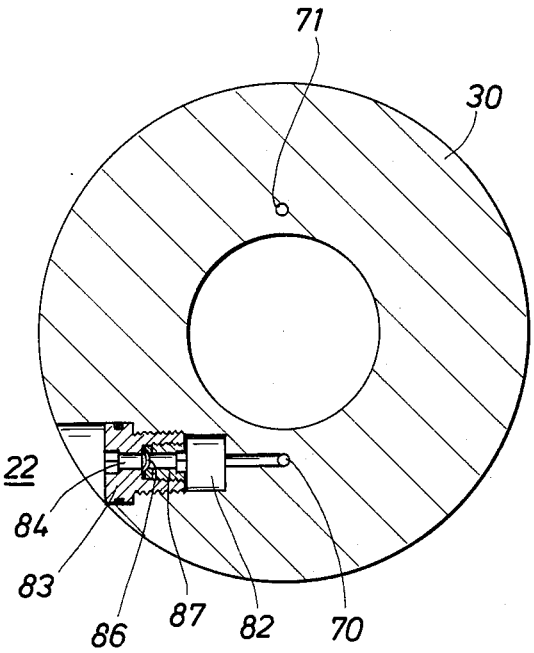
FIG. 5 is a sectional view taken along line 5—5 of FIG. 2C.

Fluid pressure for closing the ball valve of the sampler of this invention is obtained from annulus 22. As shown in FIGS. 2B, 2C and 5, drain sub 30 is equipped with longitudinally extending fluid passages 70 and 71 in the housing walls on opposite sides of the sub that extend the length of the drain sub. At the upper end of the drain sub, longitudinal passage 70 is communicated by means of facing lateral ports 73 and 74 and an annular groove 75 to a similar longitudinal passage 72 in the housing. Annular groove 75 also allows fluid pressure in passage 70 to be communicated by way of opposed ports 77 and 78 to a longitudinal passage 76 in housing 27. The fluid pressure in longitudinal passages 72 and 76 is transmitted to annular space 66 through lateral ports 79 and 80.

As shown in FIG. 5, longitudinal passage 70 in the drain sub is communicated with the well annulus 22 through port 82 that is closed by plug 83. The plug has central opening 84 that is closed by rupture disc 86 held in place by set screw 87. To close the sampler and trap formation fluid between the valves, the pressure in the annulus is built up sufficiently to rupture disc 86. This allows the pressure in the annulus to be transmitted to annular chamber 66 at the upper end of the sampler and to chamber 89 at the lower end of the sampler. The fluid pressure moves valve operator 64 downwardly thereby rotating ball 34 to the closed position as shown in FIG. 2B. In the same manner, as shown in FIG. 2D, piston 90 on operator mandrel 91 moves valve operator 92 upwardly rotating ball 35 to the closed position.

In accordance with this invention, reset means are operatively arranged to enable the valve operators to be moved freely in one axial direction for closing ball valves 34 and 35 whenever pressure is admitted to piston chambers 66 and 89; but the reset means will thereafter positively restrain the valve operators against subsequently moving in the opposite axial direction and thereby inadvertently re-opening the ball valves while the sampler is still in the well bore. The new and improved reset means are further arranged to manually re-open ball valves 34 and 35 while the sampler is at the surface. In this manner, the sampler can be readily tested in advance without having to disassemble the sampler.

In the embodiment shown, the reset means includes collet 100 which is equipped with a plurality of spaced parallel fingers 102. Threads 103 on the fingers mate with threads 104 on the upper end of operator mandrel 62. The outer end of each finger, two of which can be seen in FIG. 2A, have ridges 105 with tapered sides that can move upwardly into mating cavity 106 when the fingers are bent outwardly by the force imposed on the fingers by threads 104 on the operator mandrel as fluid pressure acts on piston 64 urging the operator mandrel downwardly, as viewed in FIG. *2a*, when the valve is being closed. In other words, the fingers will be successively expanded and contracted as they ratchet along threads 104 as the operator mandrel moves downwardly. The collet is held against longitudinal movement relative to the operator mandrel by shoulder 108 that engages the end of upper housing 27. Any tendency of the operator mandrel to move upwardly will cause the tapered sides of ridges 104 to engage the corresponding tapered side of groove 106 and prevent the fingers from moving out of engagement with the threads thereby holding the operator mandrel from such movement.

When it is desired to re-open the upper ball valve 34, as for example after the valve has been tested at the surface to see whether the valve will close properly, a tool is inserted through top sub 25 to engage slots 110 in the collet to rotate the collet. In this way, collet 100 serves as a nut with the threads 103 and 104 coacting to raise operator mandrel 64 upwardly, as viewed in FIG. 2A, and return ball 34 to the open position. The same can be done at the other end by rotating collet 112.

Figure 6:
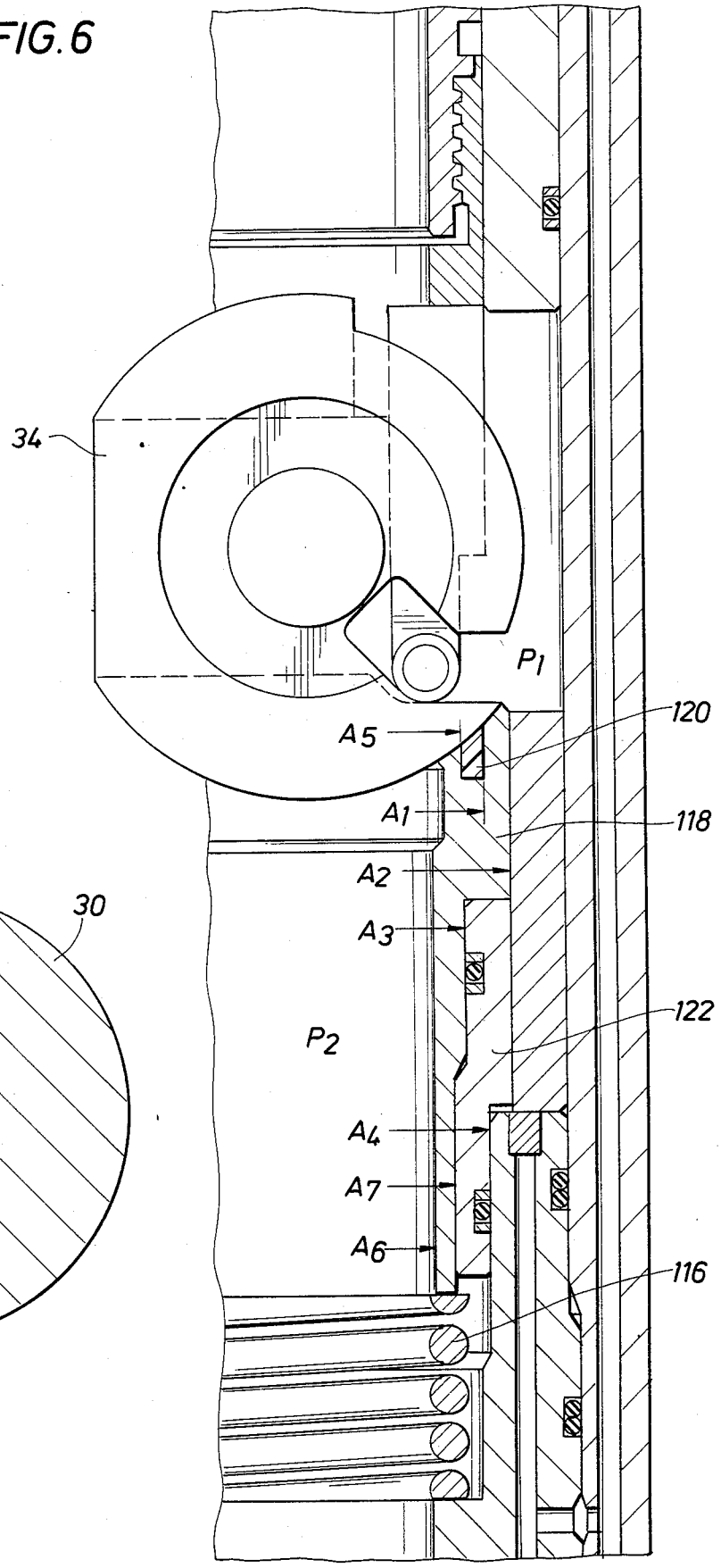
FIG. 6 is a sectional view on an enlarged scale through the ball and the valve seat of the valve of this invention.

It is a feature of this invention to provide a valve seat that will be urged into sealing engagement with the ball regardless of whether upstream or downstream pressure is the highest. This is important because one of the features and advantages of the ball valve of this invention is that it is rigidly held against movement by the upper and lower valve cages. As a result all of the forces imposed on the ball are transmitted directly to the housing of the sampler. This arrangement, however, requires that some means must be provided to urge the valve seat against the ball to maintain the desired sealing engagement therebetween. As shown in FIG. 6, the new and improved ball valve 34 includes resilient or spring means such as valve seat spring 116 which is cooperatively arranged within housing 27 for urging valve seal retainer 118 toward ball 34 to hold seal 120 in sealing engagement with the spherical surface of the ball. When the valve is initially closed, there will be no differential pressure across the valve and the force of spring 116 will be sufficient to trap the formation fluids in the sampler between the two ball valves. When packer 12 is unseated in preparation for pulling the drill test assembly out of the hole, there will be an immediate increase in the pressure differential across lower ball valve 35. At this time the pressure in the sampler acting on the upper ball valve will probably be higher than the pressure in drill string 11 above it. Therefore, at this point, outside pressure $P_1$ will be greater than inside pressure $P_2$ across ball valve 35, but inside pressure $P_2$ will be greater than outside pressure $P_1$ across ball valve 34.

As the sampler is pulled out of the well bore, the well bore annulus pressure $P_1$ imposed on the ball valve will progressively decrease so that when this pressure becomes less than the pressure $P_2$ in the sampler, the direction of the pressure differential across lower ball 35 and, at times, upper ball 34 will change. Therefore it is important that the valve remain closed regardless of the direction of the pressure differential. In FIG. 6, the various annular areas across which the pressures $P_1$ and $P_2$ act are shown. Since the ball cannot move, no force can be transmitted by $P_1$ through the ball against the seat. Therefore, forces urging seal retainer 118 away from the ball exerted by $P_1$ will be $P_1$ $(A_2-A_1)$. The force exerted by $P_1$ urging the seal retainer toward the ball is equal to $P_1$ $(A_2-A_3)$. Since $A_1$ is greater than $A_3$, then the force urging the seal retainer toward the ball will always be greater than the force urging it away from the ball valve due to outside pressure $P_1$.

Inside pressure $P_2$ is also uniquely employed for biasing the seal retainer 118 and seal 120 against the valve member 34 whenever the pressure in the sample chamber is greater than the outside pressure. In the preferred manner of accomplishing this, an annular seal follower 122 is cooperatively arranged between the valve cage 39 and seal retainer 118 and sealingly engaged therewith by inner and outer O-rings 122*a* and 122*b* mounted on the seal follower. With this arrangement, the force components urging the seal retainer away from the ball due to inside pressure $P_2$, equal $P_2$ $(A_5-A_6)$. The components from $P_2$ urging the seal retainer toward the valve and maintaining the valve closed are $P_2$ $(A_3-A_6)$. If $A_5=A_3$, then $P_2$ $(A_3-A_6)$ in the first expression will equal $P_2$ $(A_5-A_6)$ in the second expression thereby leaving only the force component $P_2$ $(A_4-A_3)$ acting upwardly on follower 122 to urge it against seal retainer 118. Therefore, $P_2$ will urge follower 122 toward seal retainer 118 to maintain seal 120 in engagement with valve member 34 whenever the sample chamber pressure is greater than the exterior pressure. In other words, with the areas $A_3$ and $A_5$ arranged to be equal, seal retainer 118 is always balanced with respect to the pressure $P_2$ in the sample chamber and is not moved thereby even when there is a lower exterior pressure $P_1$. The sample chamber pressure does, however, act against the annular surface $(A_4-A_3)$ on seal follower 122. Thus, whenever the pressure $P_2$ in the sample chamber is greater than the exterior pressure $P_1$, the resulting pressure differential biases the seal follower 122 against the seal retainer 118 which urges the seal 120 toward ball member 34. On the other hand, whenever the exterior pressure $P_1$ is higher than the pressure $P_2$ in the chamber, seal follower 122 is moved away from seal retainer 118 and stopped against the nearby housing shoulder 49. The higher exterior pressure $P_1$ in the space between the opposed faces of the retainer 118 and follower 122 is imposed on the unbalanced area defined between $A_1$ and $A_5$ on the seal retainer thereby cooperating with spring 116 to urge the seal retainer and seal 120 against ball member 34.

As explained above, the sampler of this invention employs ball valves of simplified design that are closed by hydraulic pressure independently of each other so that if for some reason one should fail to close the other valve can. Since the sampler also acts as a safety valve, the fact that one will operate when the other one doesn't is an extremely important feature.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A bottom hole sampler for obtaining a sampler of the fluids produced by a subsurface formation during a drill stem test at formation pressure and temperature comprising a tubular housing having a passageway through which fluids produced can flow during said test, a pair of ball valves spaced along the passageway to trap fluid in the passageway when the valves are closed, each valve including a ball having an opening therethrough, a valve seat engaging the ball, means mounting the ball for rotation around an axis transverse the longitudinal axis of the passageway, a valve operator connected to the ball to rotate the ball to an open position with its opening parallel to the longitudinal axis of the passageway when the operator is moved in one direction and to rotate the ball to a closed position with the opening extending transverse the longitudinal axis of the passageway when the operator is moved in the opposite direction, piston means connected to the valve operator responsive to fluid pressure to move the valve operator in said opposite direction to close the valve, and reset means operable through the open end of the housing adjacent to the valve operator for moving the valve operator in said one direction to return the valve to the open position.

2. The bottom hole sampler of claim 1 in which the reset means for each valve includes a reset member mounted for rotation adjacent the end of the housing proximate to the valve operator and cooperatively connected thereto by inner and outer threads, means for allowing the threads to ratchet relative to one another when the valve operator is moved in said opposite direction to close the valve and to prevent the threads from ratcheting relative to one another when the operator is moved in said one direction to open the valve by relative rotation of the reset member and the valve operator.

3. The bottom hole sampler of claim 2 in which the reset member is a collet having a plurality of flexible fingers connected at their ends to the valve operator by said inner and outer threads and in which the ratchet means includes a groove in the housing into which said flexible fingers flex outwardly and allow the threads to ratchet as the valve operator moves in said opposite direction to close the valve but will prevent such movement in said one direction when said reset member is being rotated to open the valve.

4. The bottom hole sampler of claim 1 further provided with means for holding the ball of each valve for rotation around a fixed axis relative to the housing and in which the valve seat of each valve includes a valve seal, a valve seal retainer movable along the longitudinal axis of the passageway, resilient means urging the valve seal retainer and the valve seal toward the ball, an annular seal follower sealingly mounted between the housing and the seal retainer and adapted for limited longitudinal movement relative thereto, said retainer and said seal follower cooperatively combining to provide a first area on said seal follower responsive to the internal pressure in the passageway between said valves for urging said seal retainer toward the ball whenever said internal pressure is greater than the pressure exterior of the passageway and to provide a second area on said seal retainer responsive to said exterior pressure for urging said seal retainer toward the ball whenever said exterior pressure is greater than said internal pressure thereby insuring that the valve seal is held in sealing engagement with the ball regardless of the direction of the pressure differential across the valve.

5. A ball valve for use in downhole tools such as bottom hole samplers and safety valves comprising a tubular housing, a ball having an opening therethrough, a valve seat engaging the ball, means mounting the ball for rotation around an axis transverse the longitudinal axis of the housing, a valve operator connected to the ball to rotate the ball to an open position with its opening parallel to the longitudinal axis of the housing when the operator is moved in one direction and to rotate the ball to a closed position with the opening extending transverse the longitudinal axis of the housing when the operator is moved in the opposite direction, piston means connected to the valve operator responsive to fluid pressure to move the valve operator in one direction, and reset means operable through the open end of the housing for moving the valve operator to return the valve to the open position.

6. The ball valve of claim 5 in which the reset means includes a reset member mounted for rotation adjacent the end of the housing and connected to the valve operator by threads, means for allowing the threads to ratchet when the valve operator is moved in a direction to close the valve and to prevent the threads from ratcheting when the operator is moved in the direction to open the valve by relative rotation of the reset member and the valve operator.

7. The ball valve of claim 5 or 6 in which the reset member is a collet having a plurality of flexible fingers connected to the valve operator by threads on the ends of the fingers and in which the ratchet means includes a groove in the housing that will allow the fingers to move outwardly and allow the threads to ratchet as the valve operator moves in the direction to close the valve but will prevent such movement when the reset means is being rotated to open the valve.

8. The ball valve of claim 5 further provide with means for holding the ball for rotation around a fixed axis relative to the housing and in which the valve seat includes a valve seal, a valve seal retainer movable along the longitudinal axis of the passageway, resilient means urging the valve seal retainer and the valve seal toward one side of the ball, an annular seal follower sealingly mounted between the housing and the seal retainer and adapted for limited longitudinal movement relative thereto, said retainer and said seal follower cooperatively combining to provide a first area on said seal follower responsive to the internal pressure in said passageway for urging said seal retainer toward said one side of the ball whenever said internal pressure is greater than the external pressure on the other side of the ball and to provide a second area on said seal retainer responsive to said external pressure for urging said seal retainer toward said one side of the ball whenever said external pressure is greater than said internal pressure thereby insuring that the valve seal is held in sealing engagement with the ball regardless of the direction of the pressure differential across the valve.

9. A ball valve assembly for use in a downhole tool, such as a bottom hole sampler or safety valve, to close the bore of the housing of the tool comprising a ball having a central bore therethrough, a valve seat engaging the ball a pair of trunnions attached to the ball on opposite sides, first and second cage members on opposite sides of the ball along the longitudinal axis of the tool in engagement with the trunnions to support the trunnions and ball for rotation thereon between an open position with the bore in the ball extending in the direction of the bore of the tool and a closed position with the bore of the ball extending transverse the bore of the tool, resilient means urging the valve seat, toward the ball a valve operator assembly including an annular cylindrical section along the bore of the tool, an annular piston located in the cylindrical section of the bore, an annular skirt attached to the piston and extending away from the piston on the opposite side from the ball to confine fluid under pressure in between the cylindrical section and the skirt to urge the piston to move toward the ball, a valve operator attached to the piston for rotating the ball to the closed position when the piston moves toward the ball and to move the ball to the open position when the piston moves away from the ball, and reset means for moving the piston away from the ball to open the valve, said means including inner and outer threads on the piston skirt and a ratchet member respectively co-engaged to allow relative longitudinal movement of the skirt and the rotating member as the piston moves toward the ball to close the valve and to move the piston and skirt away from the valve to open the valve upon relative rotation of the ratchet member and the skirt.

10. The ball valve assembly of claim 9 in which the reset member is a collet having a plurality of flexible fingers connected at their ends to the valve operator by said inner and outer threads and in which the ratchet means includes a groove in the housing into which said fingers flex outwardly and allow the threads to ratchet as the valve operator moves in said one direction to close the valve but will prevent such movement in said opposite direction when said reset member is being rotated to open the valve.

11. The ball valve assembly of claim 9 further provided with means for holding the ball for rotation around a fixed axis relative to the housing and in which the valve seat includes a valve seal, a valve seal retainer movable along the longitudinal axis of the bore of the tool, resilient means urging the valve seal retainer and the valve seal toward one side of the ball, an annular seal follower sealingly mounted between the housing and the seal retainer and adapted for limited longitudinal movement relative thereto, said retainer and said seal follower cooperatively combining to provide a first area on said seal follower responsive to the internal pressure in said bore for urging said seal retainer toward said one side of the ball whenever said internal pressure is greater than the external pressure on the other side of the ball and to provide a second area on said seal retainer responsive to said external pressure for urging said seal retainer toward said one side of the ball whenever said external pressure is greater than said internal pressure thereby insuring that the valve seal is held in sealing engagement with the ball regardless of the direction of the pressure differential across the valve.

12. A well tool adapted to be connected in a pipe string and positioned in a well bore for collecting fluids within said pipe string and comprising:

a tubular housing having an axial passage with an intermediate portion thereof defining a sample chamber;

first and second valve means within said passage at opposite ends of said sample chamber controlling communication therewith and respectively including a ball member rotatable between open and closed positions, an annular valve seat slidably mounted in said sample chamber and adapted for axial movement toward the adjacent side of said ball member, and spring means normally biasing said valve seat toward said ball member;

first and second pressure-biasing means arranged between said housing and said valve seats for urging said valve seats against said adjacent sides of said ball members and respectively including an annular follower sealingly mounted between said housing and said valve seat and adapted for axial movement relative thereto, said follower and said valve seat cooperatively combining to provide a first area on said follower responsive to the pressure in said sample chamber for urging said follower against said valve seat and thereby maintain said valve seat engaged with said ball member whenever said sample chamber pressure is greater than the pressure in said passage on the opposite side of said ball member and to provide a second area on said valve seat responsive to the pressure on said opposite side of said ball member for urging said valve seat against said ball member and thereby maintain said valve seat engaged with said ball member whenever said sample chamber pressure is less than the pressure in said passage on said opposite side of said ball member; and first and second valve-actuator means arranged for longitudinal movement in said passage on opposite ends of said housing and respectively coupled to said first and second valve means for rotating said ball members between their said open and closed positions in response to said longitudinal movement of said valve-actuator means.

13. The well tool of claim 12 further including first and second valve-reset means arranged at opposite ends of said housing and respectively accessible therefrom for manually moving said valve-actuator means to rotate said ball members from their said closed positions to their said open positions.

14. The well tool of claim 13 wherein said first and second valve-actuator means respectively include an annular piston member sealingly mounted within said passage to define a piston chamber and adapted for movement therein between longitudinally-spaced positions in response to pressure in said piston chamber.

15. The well tool of claim 14 further including first and second valve-reset means arranged at opposite ends of said housing and respectively accessible therefrom for manually moving said piston members between their said spaced positions for rotating said ball members from their said closed positions to their said open positions.

16. The well tool of claim 15 wherein each of said valve-reset means include a reset member rotatably mounted within each of said ends of said housing, and threaded means selectively coupling said reset member to said piston member and operable for releasing said piston member to move away from said reset member upon movement of said piston member to rotate said ball member to its said closed position and for retracting said piston member to move toward said reset member upon rotation of said reset member to rotate said ball member to its said open position.

17. The well tool of claim 16 wherein said threaded means include a tubular collet connected to one of said members with said collet having a plurality of outwardly-expansible fingers with enlarged end portions with internal threads coaxially disposed around the other of said members and normally coacting with external threads on said other member so that rotation of said reset member will move said piston member toward said reset member; and further including an internal groove within said housing cooperatively shaped to coact with said enlarged end portions of said collet fingers to allow said fingers to expand and disengage said threads upon movement of said piston member away from said reset member.

* * * * *